United States Patent [19]

Irvine et al.

[11] Patent Number: 4,544,150

[45] Date of Patent: Oct. 1, 1985

[54] DOCUMENT FEEDER

[75] Inventors: Robert Irvine, Riverside; Harry E. Luperti, Wilton, both of Conn.; Keith Bayliss, Swindon, England

[73] Assignee: Pitney Bowes Inc., Stamford, Conn.

[21] Appl. No.: 582,363

[22] Filed: Feb. 22, 1984

[51] Int. Cl.[4] ..... B65H 1/00

[52] U.S. Cl. ..... 271/145; 271/149; 271/166; 271/169

[58] Field of Search ..... 271/8 A, 30 A, 149, 271/166, 169, 145, 109, 8.1, 30.1

[56] References Cited

U.S. PATENT DOCUMENTS 2,652,248 9/1953 Johnson ..... 271/149 X 3,902,712 9/1975 Dorer ..... 271/166 X

*Primary Examiner*—Richard A. Schacher

*Attorney, Agent, or Firm*—Lawrence E. Sklar; William D. Soltow, Jr.; Albert S. Scribner

[57] ABSTRACT

An improvement in a document feeding device having a hopper oriented at an acute angle with respect to a horizontal plane and able to support a pack of documents to be fed seriatim therefrom. The improvement comprises at least one pad having a high coefficient of friction material situated on the upper surface of the hopper whereby the effect of the weight of the documents situated in the hopper above the pad on the pressure of the pack situated below the pad is decreased.

4 Claims, 10 Drawing Figures

DOCUMENT FEEDER

BACKGROUND OF THE INVENTION

The instant invention relates to a document feeding device, and more particularly to a device which enables an operator of a document feeding machine to control the pack pressure for various types and sizes of materials being fed from the document feeder.

Inserting machines typically include a plurality of feeding devices which feed documents from a pack of documents situated in a hopper seriatim to a transport deck therebelow, from which a collated packet of documents are eventually inserted into an envelope. The inserter document feeders employ hoppers that generally are inclined at a fixed angle which usually is somewhere between about 20 and 30 degrees. The feeder depends on gravity to slide the documents down to and against a separator roller and stone. The nature of this system is such that it is virtually impossible to maintain an ideal pack pressure and pack angle in the documents throughout the hopper's full capacity. A full hopper creates too high a pack pressure and angle while a near empty hopper creates too low a pack pressure and angle. The nature of the material being fed may also contribute to the difficulty of maintaining the optimum pack pressure and angle depending upon whether the material is glossy or rough (finish), or whether it is curled, twisted, spongy, thick or heavy.

If the pack pressure is very low, insufficient force will be generated and no documents will be fed from the hopper. The addition of more documents remedies this problem. However, when operating large inserting machines, with multiple document feeders, it is in the interest of the operator to load each hopper to capacity, thereby necessitating less frequent reloading. In many cases, especially with heavier documents such as booklets, the pack pressure then becomes excessive, and the pack pressure causes the frictional force between documents to become greater than the resistive force of the retarding element, typically the supporting surface of the hopper, causing double documents to be fed. As the gap of the separator device will not allow doubles, the feed roller "peels" the top pages of multiple sheet documents, thereby causing a jam.

The instant invention alleviates the foregoing condition and allows the operator to fully load the feeder hopper by maintaining a constant pack pressure within the desirable range.

SUMMARY OF THE INVENTION

Accordingly, the instant invention provides an improvement in a document feeding device having a hopper oriented at an acute angle with respect to a horizontal plane and able to support a pack of documents to be fed seriatim therefrom. The improvement comprises at least one pad having a high coefficient of friction material situated on the upper surface of said hopper whereby the effect of the weight of the documents situated in the hopper above said pad on the pressure of the pack of documents situated below said pad is decreased.

DETAILED DESCRIPTION

Figures 1, 2:
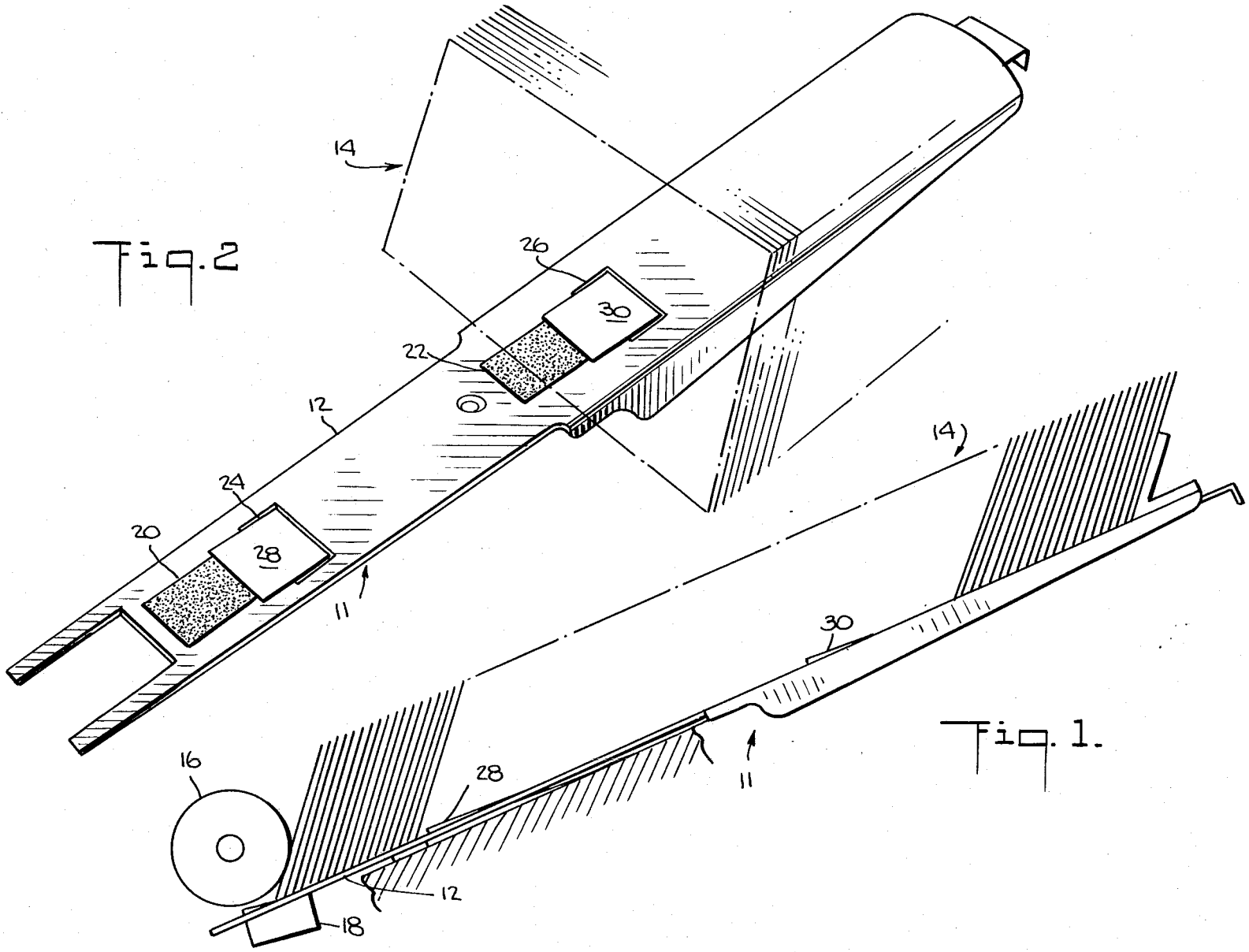
FIG. 1 is a schematic, side elevational view of a document feeding device incorporating a hopper and pads according to the instant invention.
FIG. 2 is a perspective view of the hopper and pads seen in FIG. 1.
Figures 3, 4:
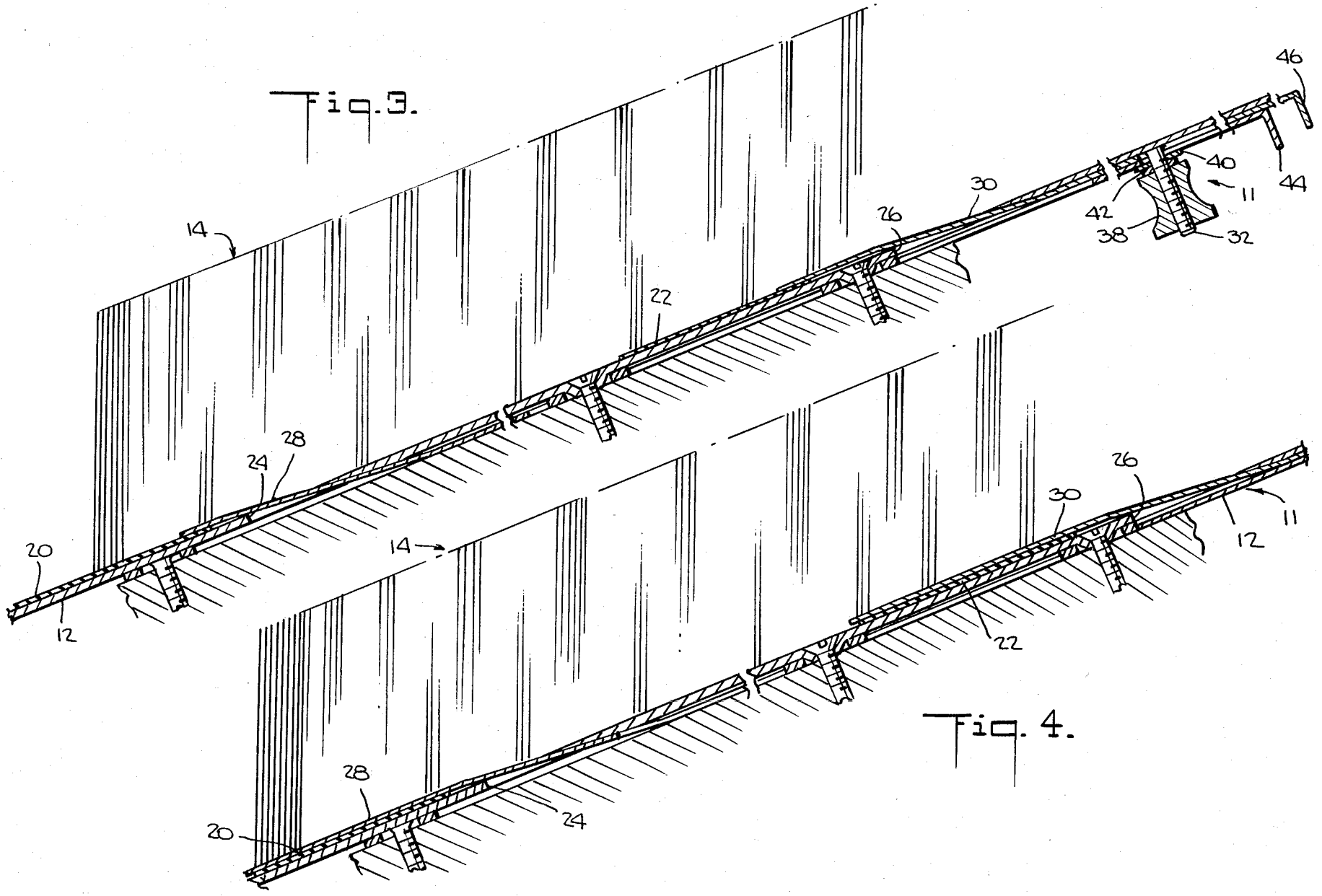
FIG. 3 is a side elevational view of the hopper and pads seen in FIG. 1 showing the pads fully exposed for maximum effect.
FIG. 4 is the same as FIG. 3 except that the pads are shown covered to negate their effect.

In describing the preferred embodiment of the instant invention, reference is made to the drawings, wherein there is seen a feeder generally designated 11 (see FIGS. 1–4) which may be part of an inserting machine (not shown) which typically includes a series of feeders. The feeder 11 includes a hopper 12 oriented at an angle of about 26 degrees to the horizontal. The hopper 12 supports a pack of documents 14 which are fed seriatim therefrom by means of a separator roller 16 and a separator stone 18 (see FIG. 1) located at the lower end of the hopper 12.

Figure 6:
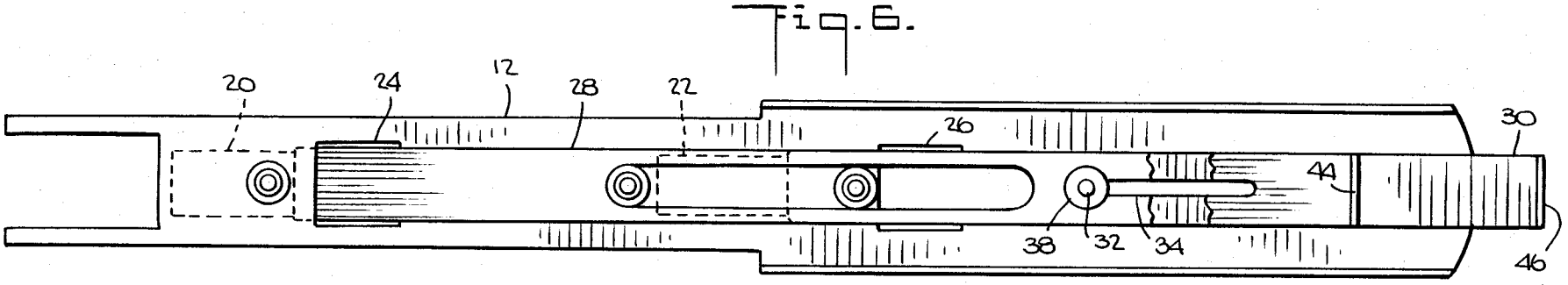
FIG. 6 is a bottom, plan view of the hopper seen in FIG. 1.

The upper surface of the hopper 12 includes a downstream pad 20 and an upstream pad 22. The downstream pad 20 is located adjacent the separator roller 16 and separator stone 18 and the upstream pad 22 is located at about the middle of the hopper 12. Upstream and adjacent each of the pads 20 and 22 are apertures 24 and 26 (see FIG. 6) respectively. Each of the pads 20 and 22 is formed from a material having a high coefficient of friction in order to provide resistance to those documents 14 above and lessen their effect on the pack pressure. The greater the area of the pad exposed, the less effect the portion of the pack of documents 14 above the pad has on the total pack pressure. Moreover, the downstream pad 20 is an additional aid in keeping the documents 14 entering the separator roller 16 and separator 18 "shingled" such that the top document leads and will be the next to feed. A preferred pad material is "Merathane", which is a trademark used by Merathane Products Inc. to identify their urethane. Another preferred pad material is rubber.

Figure 5:
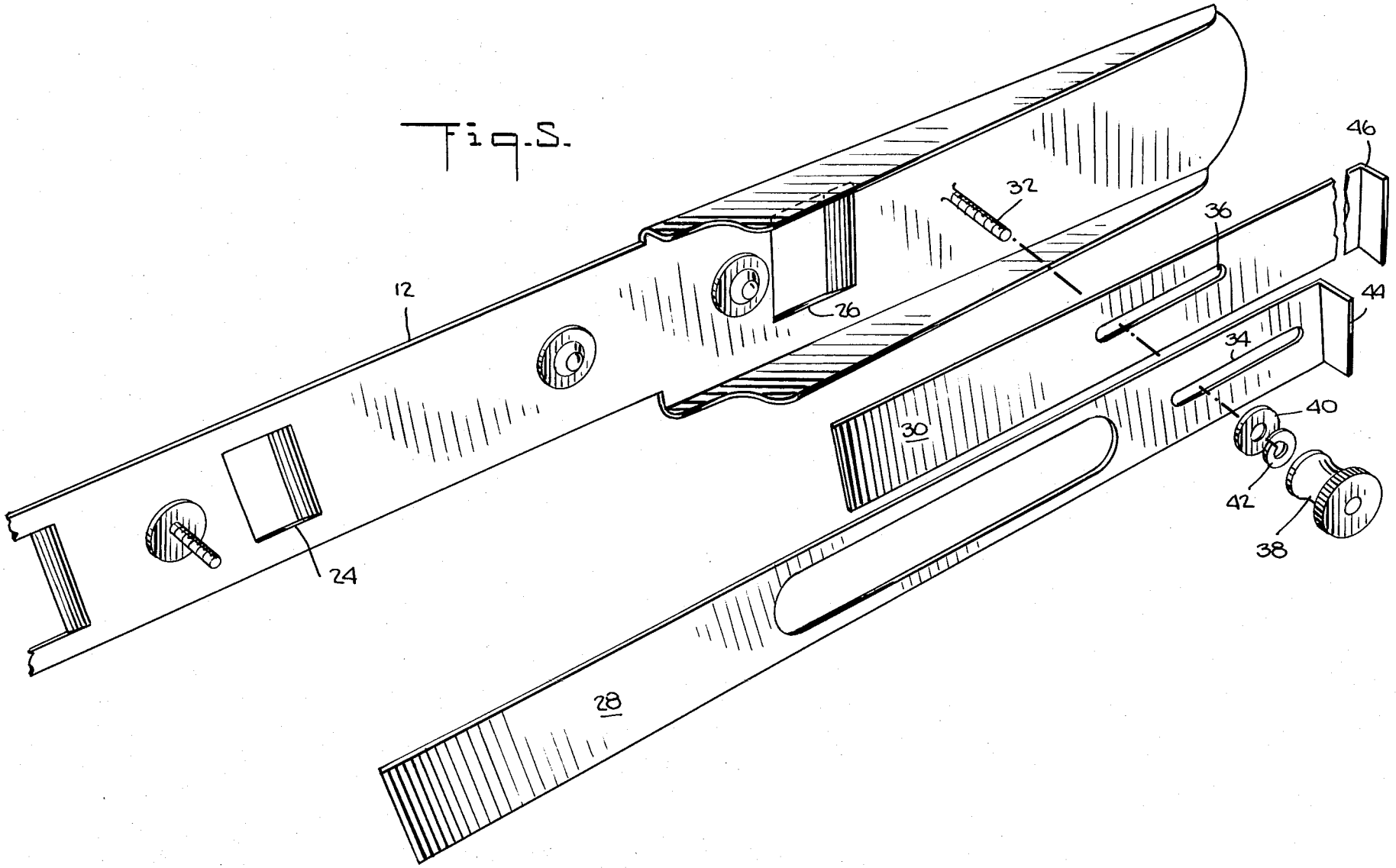
FIG. 5 is an exploded, perspective view of the underside of the hopper seen in FIG. 1.
Figure 8:
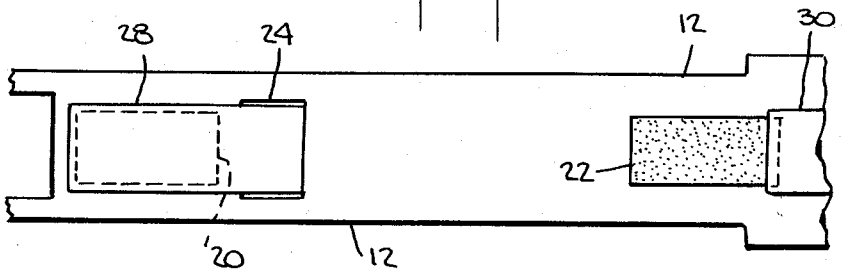
FIG. 8 is the same as FIG. 7 except that the upstream pad is fully exposed.
Figure 10:
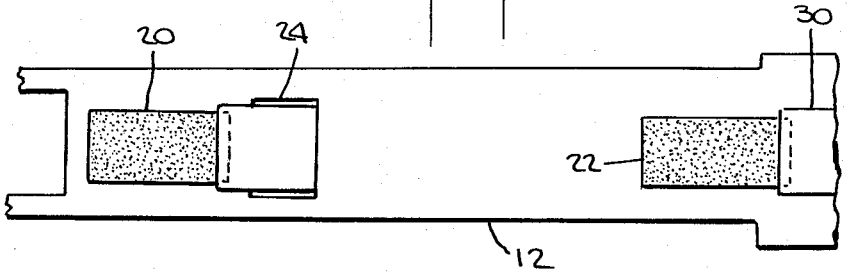
FIG. 10 is the same as FIG. 7 except both pads are fully exposed.
Figure 7:
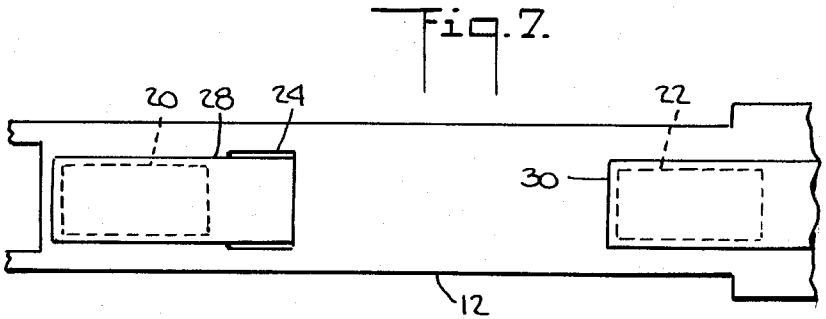
FIG. 7 is a top, plan view of the hopper and pads seen in FIG. 1 showing both pads fully covered.
Figure 9:
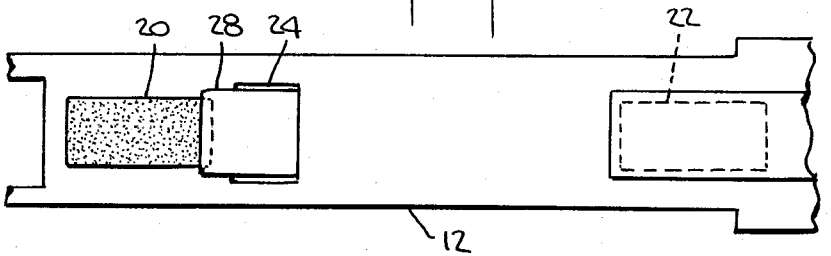
FIG. 9 is the same as FIG. 7 except that the downstream pad is fully exposed.

Each of the two pads 20 and 22 is independently controlled, and may be used separately or in conjunction to allow the operator greater control of the pack of documents 14 and, therefore, feeding. Situated beneath the hopper 12 are downstream slide 28 and upstream slide 30 immediately thereabove. The hopper 12 includes a stud 32 projecting downwardly, while the downstream slide 28 includes a longitudinal channel 34 and the upstream slide 30 includes a longitudinal channel 36 (see FIG. 5). Each of the channels 34 and 36 slidingly engages the stud 32 while the downstream end of each of the slides 28 and 30 extends through the apertures 24 and 26 respectively and over the pads 20 and 22 respectively. The slides 28 and 30 are secured to the hopper 12 by means of a locking knob 38, washer 40 and lock washer 42. The upstream end of each slide 28 and 30 includes a flange 44 and 46 respectively which functions as a handle for adjusting the amount of pads 20 and 22 to be exposed. Specifically, by loosening the locking knob 38, each of the slides 28 and 30 can be moved so that the downstream ends thereof cover all of the pads 20 and 22, as seen in FIG. 7, expose all of the pads 20 and 22, as seen in FIG. 10, cover pad 20 and expose pad 22, as seen in FIG. 8, expose pad 20 and cover pad 22 as seen in FIG. 9, or any combination therebetween. Once the proper exposure of the pads 20 and 22 has been achieved, the locking knob 38 is tightened and the slides 28 and 30 are held in place. It is up to the operator, depending upon the nature of the material being fed, to determine how much exposure is required in the pads 20 and 22. Once the operator has determined the correct exposure, variations in the length of the pack (i.e. weight) have minimal effect on the pack pressure and feeding of the documents 14.

While a particular embodiment of the invention has been shown and described, it should be understood that the invention is not limited thereto since many modifications may be made. It is therefore contemplated to cover by the present application any and all such modifications as fall within the true spirit and scope of the appended claims.

What is claimed is:

1. A document feeding device, comprising:

a hopper oriented at an acute angle with respect to a horizontal plane and able to support a pack of documents to be fed seriatim therefrom;

at least one pad having a high coefficient of friction material situated on the upper surface of said hopper whereby the effect of the weight of the documents situated in the hopper above said pad on the pressure of the documents situated below said pad is decreased; and means for adjusting the amount of pad to be exposed, said means including an aperture adjacent said pad at the upstream end thereof and a slide having a downstream end extending through said aperture and over said pad.

2. The document feeding device of claim 1, wherein the upstream end of said slide includes a flange for adjusting the amount of pad to be exposed.

3. The document feeding device of claim 2, wherein the material is a urethane.

4. The document feeding device of claim 3, wherein the material is a rubber.

* * * * *